US005388427A

United States Patent [19]

Lee

[11] Patent Number: 5,388,427

[45] Date of Patent: Feb. 14, 1995

[54] REFRIGERATOR WITH KIMCHI COMPARTMENT

[75] Inventor: Sun G. Lee, Suwon, Rep. of Korea

[73] Assignee: Samsung Electronics Co., Ltd., Suwon, Rep. of Korea

[21] Appl. No.: 115,046

[22] Filed: Sep. 1, 1993

[30] Foreign Application Priority Data

Sep. 23, 1992 [KR] Rep. of Korea ..... 92-18147[U]
Sep. 23, 1992 [KR] Rep. of Korea ..... 92-18148[U]

[51] Int. Cl.[6] ..... F25B 29/00

[52] U.S. Cl. ..... 62/331; 165/63; 62/441; 62/285

[58] Field of Search ..... 62/267, 272, 285, 331, 62/440, 441, 444; 165/63, 58, 61

[56] References Cited

U.S. PATENT DOCUMENTS

| | | | |
|---|---|---|---|
| 2,075,838 | 4/1937 | Torrey | 62/441 |
| 2,496,252 | 1/1950 | Norrish et al. | 62/285 |
| 3,608,627 | 9/1971 | Shelvin | 165/2 |
| 3,638,717 | 2/1972 | Harbour et al. | 165/30 |
| 5,228,499 | 7/1993 | Yoon | 165/2 |

*Primary Examiner*—Henry A. Bennett
*Assistant Examiner*—William C. Doerrler
*Attorney, Agent, or Firm*—Burns, Doane, Swecker & Mathis

[57] ABSTRACT

A refrigerator has a freezer compartment, a refrigeration compartment located beneath the freezer compartment, and a heating/cooling compartment located beneath the refrigeration compartment. The heating/cooling compartment contains its own heating and cooling mechanisms mounted on external surfaces of walls which form the heating/cooling compartment. The heating/cooling compartment can be used to ferment and then store food such as kimchi.

15 Claims, 3 Drawing Sheets

REFRIGERATOR WITH KIMCHI COMPARTMENT

FIELD OF THE INVENTION

The present invention is related to a refrigerator with a kimchi compartment which can ferment kimchi at both lower and higher temperatures, and can store the cured kimchi by circulating cool air.

BACKGROUND OF THE INVENTION

The ordinary refrigerator is utilized to store various foodstuffs in either a frozen or a refrigerated condition to extend the freshness of the foodstuffs for a long period of time. Such a refrigerator is comprised of two cooling sections, one of which is a direct cooling type, that is, the evaporator used in a refrigerating cycle is installed in a food storage space and the effect of a direct heat-exchange is achieved. The other type of cooling section is the indirect cooling type, that is, an evaporator is mounted in an air passage remotely of the food storage space; the air is heat-exchanged by the evaporator and then the heat-exchanged air is directed to the food storage space by a fan.

The above refrigerator normally consists of a freezing compartment and a refrigerating compartment located below the freezing compartment. Further, the refrigerating section is provided with a separate space with a temperature different from that of the main refrigerating compartment, and it is called a "vegetable storage area" or a "chilled compartment" for storing meats etc. In these spaces, the foodstuffs can be individually stored in accordance with the desired conditions. On the front face of both the freezing compartment and the refrigerating compartment a door is installed on hinges on one vertical side shaft of the door so that foodstuffs can be placed in or removed from the compartment.

In the above described conventional refrigerator, the space for separately storing foodstuffs is restricted to only the freezing compartment and the refrigerating compartment. The space is so small that the desire of the user, following the current trend for foodstuffs which are stored in a fresh condition, can not be satisfied. To solve this problem, the refrigerator having a large number of separate compartment has recently been developed.

The refrigerator is used for increasing the storage space in order to allow foodstuffs to be stored in accordance with the temperature range corresponding to the individual characteristic of the particular foodstuff, and for making the operation of the door convenient. The typical conventional refrigerator having a separate compartment is disclosed in U.S. Pat. No. 3,638,717. The refrigerator has an advantage resulting from the increase in the storage volume and the convenience of the door operation. However, a problem occurs when various types of fermented foodstuffs e.g. kimchi are stored together with other foodstuffs in the same space.

Kimchi is a mixed vegetable dish made of picked vegetables combined with various seasonings. Kimchi is usually stored in a container and is fermented at room temperature to fully develop the taste of kimchi. The cured kimchi is then stored in a refrigerator. Since kimchi is usually made in a voluminous and heavy amount, a large storage space is required. As foodstuffs stored alongside the kimchi container are taken in or out of the refrigerator, they are disturbed by the kimchi container.

Particularly, as kimchi is being fermented, kimchi produces a unique odor which is then contained in the cool air which is circulated in the compartment. There is a problem in that the odor often adversely affects other foodstuffs.

Further, when the door is opened so as to put in or take out foodstuffs, the odor is discharged from the compartment, thereby causing the user displeasure. Also, relatively large door must be opened to remove the relatively small amounts of foodstuff and thus a great deal cool air is discharged so that the efficiency of the refrigerator is reduced.

To resolve the above defect, the typical refrigerator having a separate compartment is disclosed in U.S. Pat. No. 5,228,499. In the refrigerator, the separate compartment is located between the freezing compartment and the refrigerating compartment. A heater and a fan are mounted in the separate compartment to ferment foodstuffs placed there. When the foodstuffs must be stored, cool air is generated by an evaporator which is located between the freezing compartment and the separate compartment, and the air is directed into the separate compartment by means of a damper.

However, there is still a problem in that the interior volume of the separate compartment is reduced because the separate compartment contains the fan and the heater therein. Another problem is that since the heater is located in a restricted place, a variation exists between the temperature range adjacent to the heater and that away from the heater. This variation causes an uneven temperature distribution in the separate compartment.

Further, the separate compartment with the, highest temperature has one side placed adjacent to the freezing compartment having the lowest temperature. The refrigerating compartment, which has a temperature lower than the temperature of the separate compartment and higher than the temperature of the freezing compartment, is located at the opposite side of the separate compartment. Such an arrangement of compartments causes a problem in that the efficiency of the heat transfer among compartments is increased and the efficiency of the storage of foodstuffs is decreased.

SUMMARY OF THE INVENTION

The present invention provides a refrigerator which easily and effectively solves the above mentioned problems.

The object of the present invention is to provide a refrigerator in which the efficiency of the fermenting and storage compartment is at a maximum level, so that kimchi can be stored with the right taste for a long period of time.

Another object of the present invention is to provide a refrigerator in which the condensation formed in the kimchi compartment drains to the outside of the refrigerator so as to increase the freshness in the kimchi compartment.

According to the present invention, the refrigerator comprises a refrigerating compartment, a freezing compartment located above the refrigerating compartment, an evaporator located in the freezing compartment for delivering heat-exchanged air to both the freezing compartment and the refrigerating compartment, and a separate kimchi compartment located beneath the freezing compartment for fermenting kimchi stored therein with both lower and higher temperatures and for storing the cured kimchi in a constant cool condition.

Further, the kimchi compartment comprises a front open case which has a cooler which abuts the front portion of the wall of the compartment and a heater which abuts the remaining portion wall of the compartment.

Furthermore, the refrigerator comprises a drain apparatus by which any water generated on the inner plate of the evaporator attached wall is directed onto the bottom surface of the compartment and is drained to the outside of the refrigerator. The drain apparatus comprises a floor upon which the kimchi container is to be placed and a groove is indented along the perimeter of the floor in order to collect the drain water, the groove comprises a first portion and a remaining portion, the remaining portion is inclined to cause the drain water to gravitate toward the first portion, and the first portion has a discharge opening for discharging the drain water out of the kimchi compartment.

DETAILED DESCRIPTION OF THE PREFERRED EMBODIMENT

Figure 1:
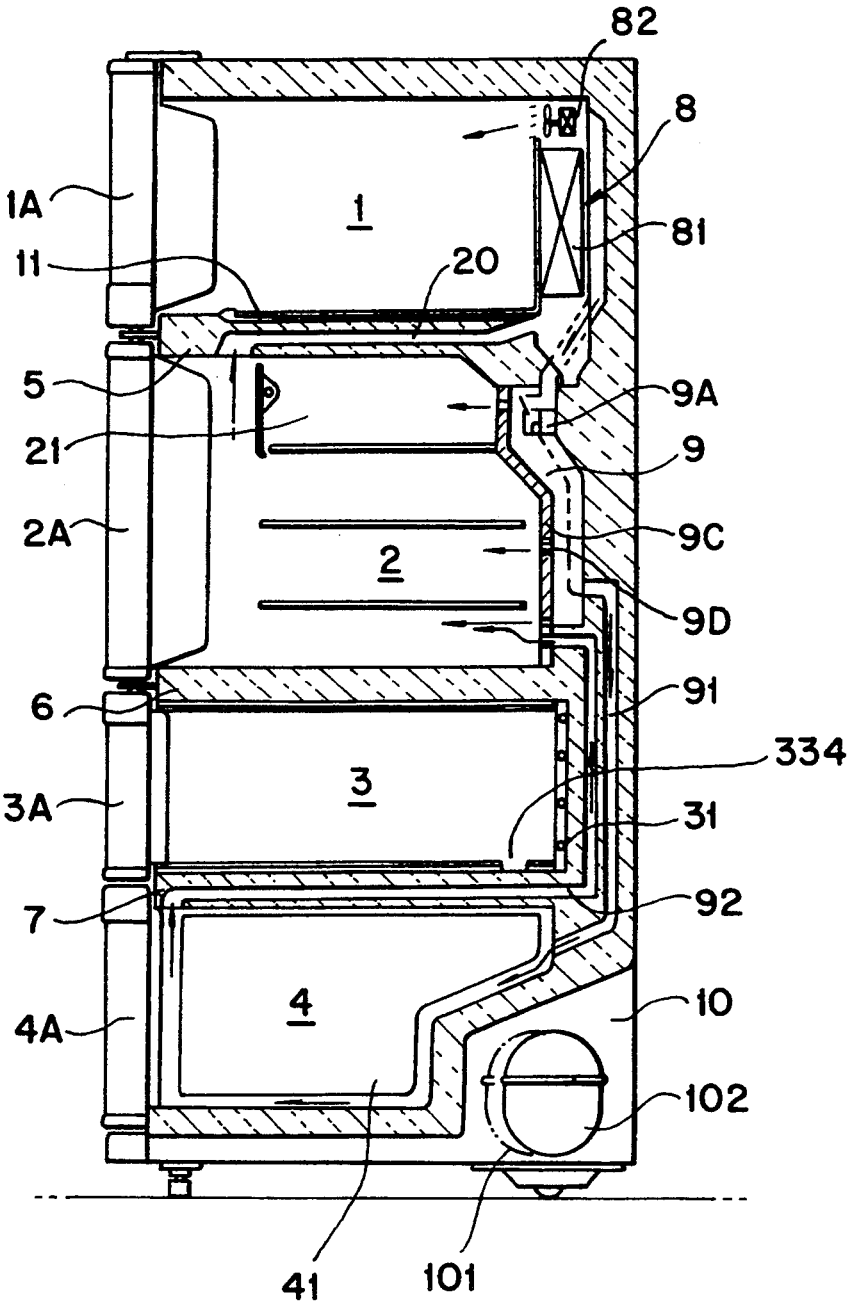
FIG. 1 is a crosssectional view of a refrigerator which possesses a kimchi compartment according to the present invention.

FIG. 1 illustrates a refrigerator having a kimchi compartment in accordance with the preferred embodiment of the present invention.

The refrigerator includes freezing compartment 1, refrigerating compartment 2, a heating/cooling kimchi compartment 3 and vegetable compartment 4 which are located in a vertical row. The freezing compartment 1 and the refrigerating compartment 2 are equipped with door 1A,2A at the front portion of the compartments 1,2, respectively. Each door 1A, 2A is hinged along the vertical axis on one of its sides. The kimchi compartment 3 has a door 3A, at the front which is hinged along its lower horizontal edge. The vegetable compartment 4 has a door 4A, which is integrally formed to be a part of the vegetable box 41 for sliding it forward or backward.

Further, a first partition wall 5 is formed between the freezing compartment 1 and the refrigerating compartment 2, a second partition wall 6 is between the refrigerating compartment 2 and the kimchi compartment 3, and a third partition wall 7 is between the kimchi compartment 3 and the vegetable compartment 4. This structure is intended to reduce the heat transfer between compartments 1,2,3 and 4. At the rear wall of the freezing compartment 1 is provided a heat-exchanging compartment 8 which has an evaporator 81 and a fan 82. The heat-exchanging compartment 8 is connected to both the freezing compartment 1 and the refrigerating compartment 2. The air heat-exchanged by the evaporator 81 flows directly into the freezing compartment 1, while the remaining air flows through the main duct 9 to the refrigerating compartment 2 under the control of a thermodamper 9A.

The main duct 9 is connected with a first sub-duct 91 which is located in the rear wall of the refrigerator behind the kimchi compartment 3 and the vegetable compartment 4, respectively. A second sub-duct 92 is formed in a rear wall of the rear wall of the refrigerator and in the third partition wall 7 and is intended to circulate air between the vegetable compartment 4 and the refrigerating compartment 2. In the upper portion of the first partition wall 5 adjacent to the freezing compartment 1, there is provided an air duct 11 by which the air from the freezing compartment 1 is directed back to the heat-exchanging compartment 8. Adjacent to the refrigerating compartment 2 in the lower portion of the first partition wall 5 an air duct 20 is provided by which the air from the refrigerating compartment 2 is directed back into the heat-exchanging compartment 8. First and second compressors 101, 102 are housed in a machine storage compartment 10 which is formed at the bottom rear portion of the vegetable compartment 4. The first compressor 101 is connected to the evaporator 81 in the heat-exchanging compartment 8, while the second compressor 102 is connected to an evaporator 31 of the kimchi compartment 3, which will next be explained.

Figure 2:
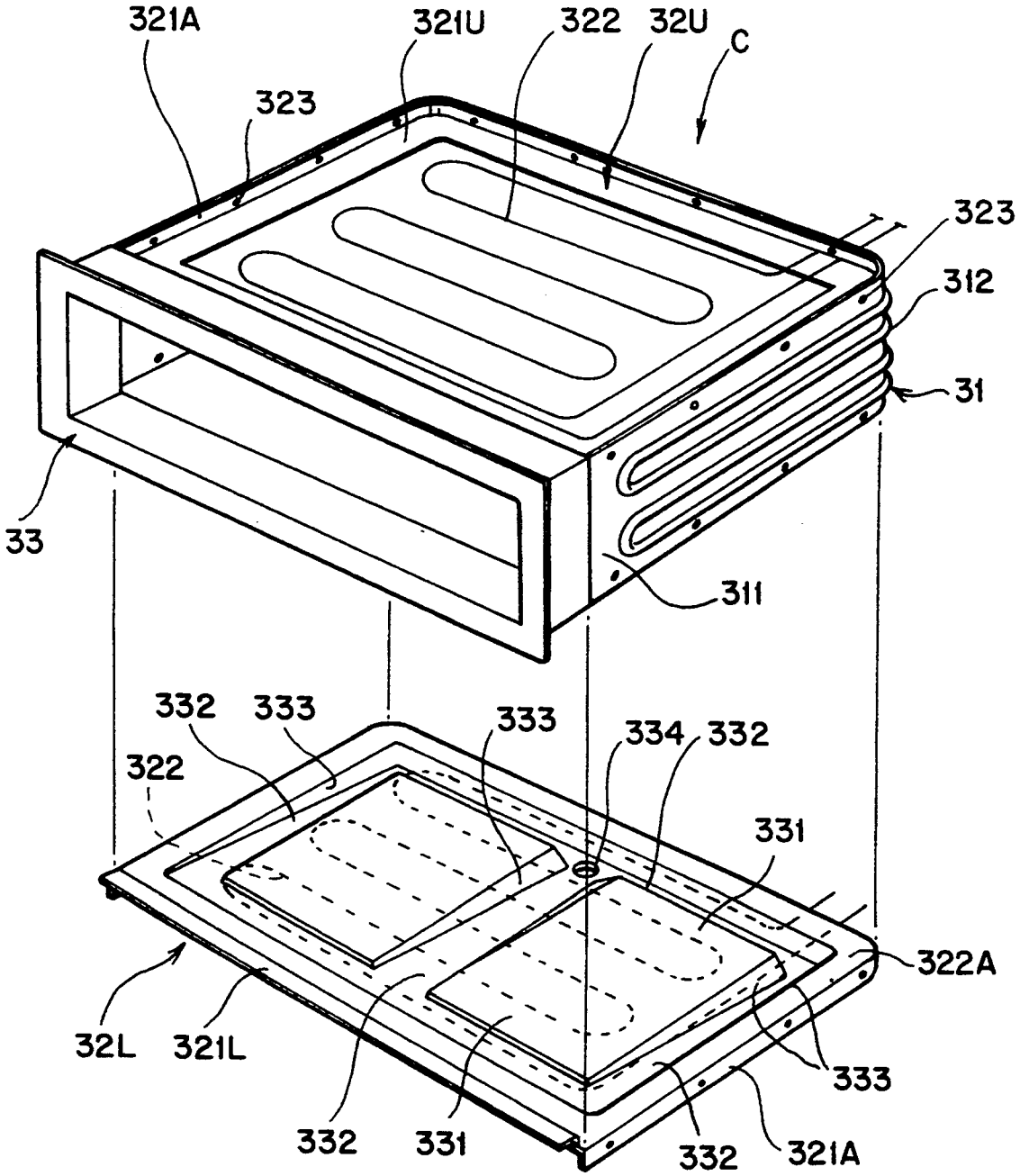
FIG. 2 is an exploded perspective view of the kimchi compartment according to the present invention.
Figure 3:
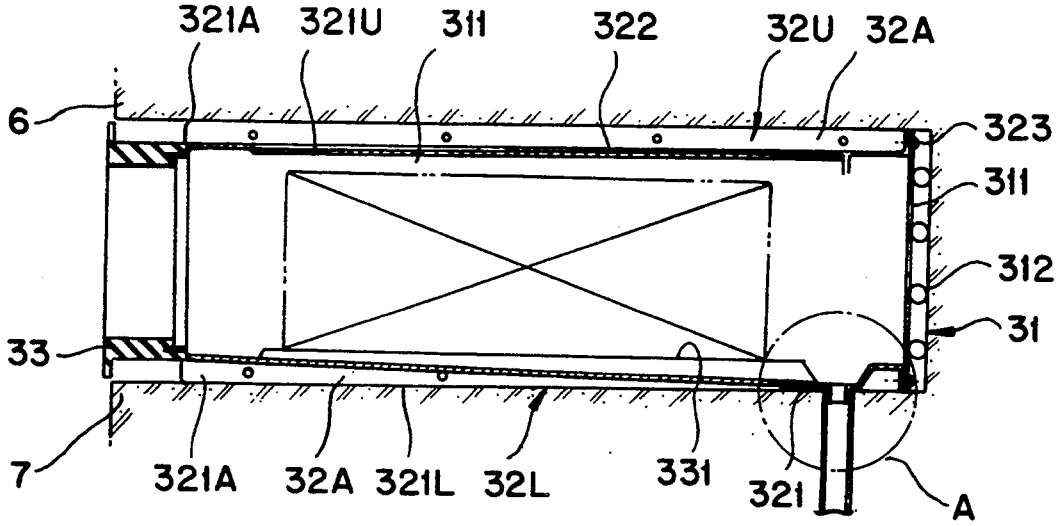
FIG. 3 is a crosssectional view of the kimchi compartment shown in FIG. 2.

The kimchi compartment 3 comprises a frame 33 and a rectangular case C the front portion of which is open, as illustrated in FIGS. 2 and 3. The frame 33 is shaped in a rectangular form to fit into the front portion of the case C.

The case C comprises a heater and a cooling member 31. The heater comprises lower and upper heating sections 321L,321U which include a lower heating plate 321L and an upper heating plate 321U, respectively, each of which has an outward upright portion 321A along its entire peripheral edge except for its front portion. A heating cord 322 is arranged on the outer face of each heating plate in a zig-zag pattern. With this structure, air in the compartment 3 is actively circulated in an upward and downward direction so as to prevent an uneven air temperature in the kimchi compartment 3. The upright portion 321A is assembled to the interior surface of the cooling member 31 by screws 323. The upper and lower upright portions 321A engage the bottom surface of the second wall 6 and the upper surface of the third wall 7, respectively, to create spaces 32A for insulation.

The cooling member 31 is provided with a cooling plate 311 which forms the right wall, the left wall and the rear wall of the case C. The cooling member 31 is further provided with a cooling pipe 312 located on the outer face of the cooling plate 311. The cooling pipe 312 is connected to a capillary tube (not shown) which is connected to the second compressor 102 and a second condenser (not shown). With the above pipe arrangement, any uneven air temperature in the kimchi compartment 3 is prevented.

Figure 4:
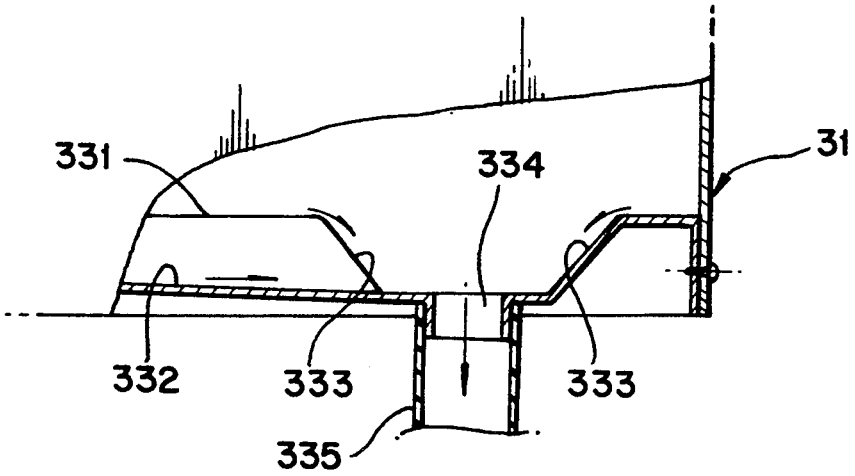
FIG. 4 is an enlarged view of portion "A" in FIG. 3.

Further, a floor 331 is provided in each half of the lower heating plate 321L. A groove 332 is formed at the peripheral portion 322A of the heating plate 321L and extends completely around each floor 331. The groove 332 is inclined to cause drain water generated on the interior surface of the cooling member 31 to gravitate to a discharge opening 334. The discharge opening 334 is formed in the groove of the rear portion of the lower heating plate 321L. The drain water flows through the discharge opening 334 into a drain hose 335 and then to an evaporating dish (not shown). Illustrated in FIGS. 2 and 4, drain water inducing surfaces 333 are inclined at the border between the floor 331 and the groove 332 as well as at the border between the groove 332 and the peripheral portion 322A.

The operation of the refrigerator containing the kimchi compartment described above will now be explained with reference to the attached drawings.

As electrical power is supplied to the first compressor 101, a refrigerant is compressed into a high temperature gas under high pressure and is directed through a condenser and a capillary tube which are not shown in Figures in order to be changed into a lower temperature liquid refrigerant under low pressure. The liquid then flows into the evaporator 81 and thus the air directed into the heat-exchange compartment 8 is heat-exchanged by contacting the evaporator and thus to be turned into cool air. The cool air is supplied into the freezing compartment 1 by the fan 82 where it cools foodstuffs in the freezing compartment 1.

After that, the air is directed back into the heat-exchanging compartment 8 through the air duct 11. Further, the other remaining air discharged from the heat-exchanging compartment 8 is directed into the main duct 9. Some of the air in the main duct 9 is directly discharged into the refrigerating compartment 2 through an outlet 9D of the main duct cover 9C. Some of the air in the main duct 9 is directed into the refrigerating compartment 2 through the sub-duct 91,92, with the result that foodstuffs in the vegetable compartment 4 are kept cool. Thus, the entire amount of air in the refrigerator is fed back into the heat-exchanging compartment 8 to continue the cycle.

Next, a fermenting and storing procedure for kimchi in accordance with the present invention will be explained as follows.

Kimchi which is made with various seasonings, is stored in a kimchi container and is inserted into the kimchi compartment 3. As the door 3A is closed, a high temperature button or a low temperature button (not shown) is selected in accordance with the desired ferment condition and then the fermentation signal is sent to the control portion (not shown). Upon a command from the control portion, power is applied to the heating cord 322 which is placed on the exterior surface of each heating plate 321L,321U. As each heating plate is heated the heat from the plate is evenly transmitted to the air in the kimchi compartment 3. The warm air in the compartment then uniformly ferments the kimchi. The heat generated from the plate is seldom transmitted to the second partition wall 6 and the third partition wall 7 due to the insulation space 32A.

After the kimchi has finished fermenting according to the commands from the control portion, the operation of the heater is stopped and the second compressor 102 is then started. With the operation of the second compressor 102, the low temperature refrigerant under low pressure directed out through a second condenser and a capillary tube which are not illustrated. The refrigerant is then directed into the cooling pipe 312 which is enclosed on the exterior surface of the cooling plate 311. The air in the kimchi compartment 3 is heat-exchanged with the refrigerant and the fermented kimchi is then directly cooled by the cool air.

As a result of the kimchi being stored in the kimchi compartment 3 with direct cool air, vapors in the air in the kimchi compartment 3 condense due to the difference in temperature between the air and the cooling member 31. The condensation flows down to the lower heating plate 321L and is guided by the drain water inducing surface 333 to reach the groove 332. The inclined groove 332 leads the drain water to the drain opening 334 and the drain water through the discharge opening 334 flows into a drain hose 335 and reaches an evaporating dish (not shown).

In the above described refrigerator with a kimchi compartment, because the heater is mounted along the entire exterior surface of the upper plate and of the lower plate, kimchi stored in the kimchi compartment can be uniformly fermented. Because the cooling pipe is located on the external surface of the cooling member, the cured kimchi can also be stored in the kimchi compartment in an uniformly cool condition. Further, because the heater and the cooling pipe are installed on the exterior surfaces of the kimchi compartment, the interior storage area of the kimchi compartment is maximized.

Furthermore, the kimchi compartment has the effect of decreasing variations in the temperatures in the compartments which adjoin each other, thereby reducing the amount of heat transferred and increasing the efficiency of the storage unit.

Additionally, the condensation which forms in the kimchi compartment is collected to be drained to the outside of the refrigerator, thereby maintaining the kimchi in a fresh condition for a long time.

The above described structural kimchi compartment can be utilized in addition to a kimchi storage compartment as either a freezing compartment or a refrigerating compartment by selectively controlling the temperature. Also, the kimchi compartment can be utilized as a chilled compartment or a wine storage compartment holding with a steady temperature of minus 1° C.

What is claimed:

1. A refrigerator comprising:

a refrigerating compartment;

a freezing compartment located above said refrigerating compartment;

a main cooling apparatus including an evaporator for producing cold air, said evaporator disposed at an elevation higher than a lowermost portion of said refrigerating compartment;

an air flow passage system communicating said evaporator with said refrigerating and freezing compartments for providing cold air to said freezing compartment and said refrigerating compartment; and a heating/cooling compartment disposed beneath said refrigerating compartment and including its own heating and cooling mechanisms which are selectively actuable for heating and cooling said heating/cooling compartment independently of operation of said main cooling apparatus;

said air flow passage system being isolated from said heating/cooling compartment so that odors in said heating/cooling compartment are not circulated to said refrigerating and freezing compartments through said air flow passage system.

2. A refrigerator according to claim 1, wherein said heating/cooling compartment has front and rear walls, top and bottom walls, and two side walls, said cooling mechanism disposed on external surfaces of some of said rear, top, and lateral walls, and said heating mechanism disposed on external surfaces of the remainder of said rear, top, and lateral walls.

3. A refrigerator according to claim 1, wherein said heating mechanism is mounted on an external surface of at least one horizontal wall of said heating/cooling compartment, and said cooling mechanism is mounted on an external surface of at least one vertical wall of said heating/cooling compartment.

4. A refrigerator according to claim 1, wherein said heating and cooling mechanisms are mounted on external surfaces of walls defining said heating/cooling compartment.

5. A refrigerator according to claim 1, wherein said heating mechanism comprises an electrical heater mounted on an external surface of a wall of said heating-/cooling compartment, and said cooling mechanism comprises a fluid-conducting pipe mounted on an external surface of another wall of said heating/cooling compartment.

6. A refrigerator according to claim 1, wherein said heating mechanism is disposed on exterior surfaces of top and bottom walls of said heating/cooling compartment, and said cooling mechanism is disposed on exterior surfaces of two side walls and a rear wall of said heating/cooling compartment.

7. A refrigerator according to claim 1 further including a first horizontal wall separating said refrigerating compartment from said heating/cooling compartment, and a second horizontal wall disposed beneath said heating/cooling compartment, there being a first air space formed between said heating/cooling compartment and said first wall.

8. A refrigerator according to claim 7, wherein a second air space is formed between said heating/cooling compartment and said second wall.

9. A refrigerator according to claim 1, wherein said heating/cooling compartment includes a bottom wall, said heating mechanism comprising a lower electrical heating coil disposed on an external surface of said bottom wall.

10. A refrigerator according to claim 9, wherein said heating/cooling compartment further includes a top wall, said heating mechanism including an upper electrical heating coil mounted on an external surface of said top wall.

11. A refrigerator according to claim 1, wherein said evaporator is disposed between said freezing compartment and a rear wall of said refrigerator.

12. A refrigerator according to claim 11, wherein a condensation drain is formed in a bottom wall of said heating/cooling compartment, at least a portion of an inside surface of said bottom wall being inclined to conduct condensate toward said drain.

13. A refrigerator according to claim 12, wherein said inside surface includes two horizontal sections, said portion of said inside surface comprising a groove arrangement surrounding both of said horizontal sections, said drain formed in said groove arrangement.

14. A refrigerator according to claim 1, wherein said heating/cooling compartment comprises a case containing said heating and cooling mechanisms, and a frame mounted to a front portion of said case, said frame including a door.

15. A refrigerator according to claim 1, wherein said heating/cooling compartment comprises a kimchi compartment for fermenting kimchi at a fermenting temperature, and for storing the fermented kimchi at a storage temperature lower than said fermenting temperature.

* * * * *